US006474490B1

(12) United States Patent
Seibel et al.

(10) Patent No.: US 6,474,490 B1
(45) Date of Patent: Nov. 5, 2002

(54) COMBINED CONTAINER CAP AND LIFT TAB OPENER

(75) Inventors: Lawrence P. Seibel, Kenosha, WI (US); Kara E. Sturdy, Racine, WI (US); Jill K. Koch, Gurnee, IL (US); Robert P. Moran, Paddock Lake, WI (US); Linda D. Ramos, Racine, WI (US)

(73) Assignee: Label Makers, Inc., Pleasant Prairie, WI (US)

( * ) Notice: Subject to any disclaimer, the term of this patent is extended or adjusted under 35 U.S.C. 154(b) by 21 days.

(21) Appl. No.: 09/709,925

(22) Filed: Nov. 10, 2000

(51) Int. Cl.[7] ..... B65D 65/32
(52) U.S. Cl. ..... 215/232; 215/254; 220/359.2
(58) Field of Search ..... 215/232, 253, 215/254, 256, 257, 323, 326; 220/359.1, 359.2, 359.4, 270, 276

(56) References Cited

U.S. PATENT DOCUMENTS 2,652,165 A * 9/1953 Wener ..... 215/254
3,314,565 A * 4/1967 Wheaton et al. ..... 215/254
3,347,407 A * 10/1967 Coolidge et al. ..... 220/270
3,557,998 A * 1/1971 Collie ..... 220/270
3,572,579 A * 3/1971 Mueller et al. ..... 220/270
4,256,233 A * 3/1981 Harding ..... 215/254
4,712,706 A * 12/1987 Nakata et al. ..... 220/270

* cited by examiner

*Primary Examiner*—Nathan J. Newhouse
(74) *Attorney, Agent, or Firm*—Reising, Ethington, Barnes, Kisselle, Learman and McCulloch, PC

(57) ABSTRACT

A container cap for use on a container top. The container cap includes a heat-sealable central portion for securing to the bottle top rim, a peripheral portion integral with the central portion adapted to be formed into a skirt around the neck of the container top, at least one lift tab connected to the peripheral portion, and a predetermined weakened line formed on one of the central or peripheral portions. The weakened line is operatively connected to one or more lift tabs in alternate arrangements.

17 Claims, 5 Drawing Sheets

COMBINED CONTAINER CAP AND LIFT TAB OPENER

FIELD OF THE INVENTION

This invention relates generally to container caps and, more particularly, to container caps having lift tab openers.

BACKGROUND ART

Container caps with lift tab openers are well-known in the market place. Some are heat-sealed onto a container, such as shown, for example, in the prior art FIG. 1. Others are screw caps, such as found on orange juice and milk gallon jugs, with a peripheral skirt connected by a weakened line around the bottom edge of the screw cap, and having a lift tab extending downwardly therefrom.

DISCLOSURE OF THE INVENTION

A general object of the invention is to provide an improved cap and lift tab opener for a container, such as a bottle or other type of container.

Another object of the invention is to provide a container cap and a single lift tab which functions to remove the container cap from a container top with controlled tearing.

A further object of the invention is to provide for use on a container top a container cap and a single lift tab having a weakened tear line formed from an edge of the lift tab and on the bottle cap in a predetermined configuration, which is adapted to progressively tear as the lift tab is being lifted, to thereby enhance the removal of the remaining portion of the cap upon reaching the end of the tear and continuing to lift.

A still further object of the invention is to provide for use on a container top additional alternate embodiment of a container cap having two lift tabs, with a weakened tear line extending from an edge of one of the lift tabs in an annular ring around a major portion of the cap. After tearing the weakened line to its end by lifting the one tab, lifting the second lift tab then serves to remove the cap in one piece Still another object of the invention is to provide for use on a container top a second alternate embodiment of a container cap having two lift tabs and a weakened tear line extending from one edge of one of the lift tabs, around the container cap to terminate at the other edge of the one lift tab, whereupon lifting the lift tab removes the outer peripheral portion of the container cap. Then, lifting the second tab serves to remove the central remaining portion of the cap from the open edge of a container to which it had been adhered.

A still further object of the invention is to provide for use on a container top a third alternate embodiment of a container cap having three lift tabs and a weakened tear line extending from the inner edge of one outside lift tab to the inner edge of the other outside lift tab. In operation, lifting either outside tab by the user's respective right or left hand, and tearing the complete weakened tear line removes the outer peripheral cap portion, setting up the removal of the central remaining portion by lifting the center lift tab.

Still another object of the invention is to provide for use on a container top additional alternate embodiments wherein inner lift tabs are formed by being cut through or partially through outer primary lift tabs, in cooperation with weakened line(s) operatively connected to the inner lift tabs, serving to permit removal of the cap in two pieces.

A further object of the invention is to provide for use on a container top, a further alternate embodiment of a container cap, wherein the two ends of a continuous weakened line formed around the cap bend outwardly to terminate at the edge of the cap a predetermined distance apart to thereby provide an intermediate lift tab.

A still further object of the invention is to provide for use on container tops, a still further alternate embodiment of a container cap, wherein a weakened line is formed from an edge of a lift tab around a peripheral portion of the cap and thence continuing around a portion of the central segment of the cap.

Another object of the invention is to provide for use on container tops, caps which are readily cut and selectively scored, partially cut, or perforated from a web of suitable material which may have been printed with selected indicia, and which may be heat sealed or induction sealed and formed to mount onto the container tops.

These and other objects and advantages will become more apparent when reference is made to the following drawings and the accompanying description.

BEST MODE FOR CARRYING OUT THE INVENTION

Figure 1:
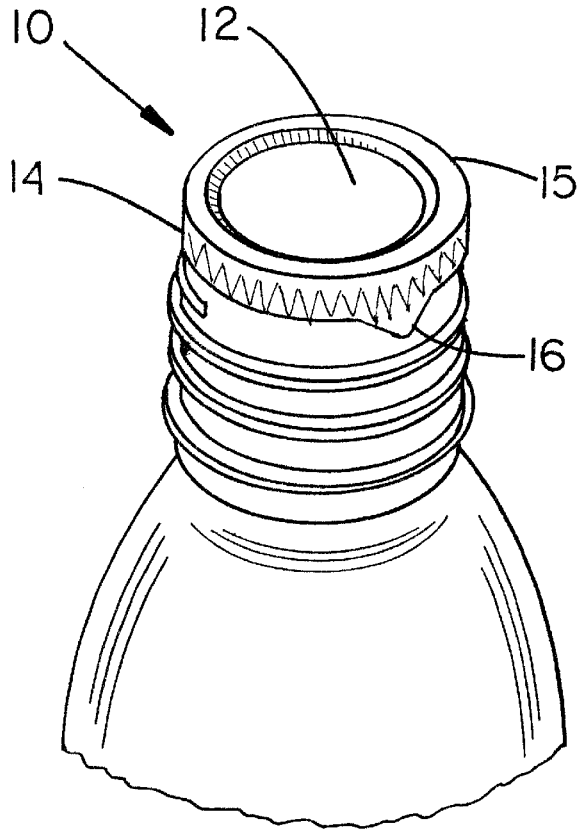
PRIOR ART FIG. 1
FIG. 1 is a perspective view of a prior art cap mounted on the open end of a fragmentary bottle.

Referring now to the drawings in greater detail, FIG. 1 illustrates a prior art cap assembly 10 formed of a heat-sealable material and including a central cover portion 12 sealed to a bottle top 14 edge, with a peripheral skirt 15 mounted around the bottle top. A lift tab 16 is formed on an edge of the skirt 15. The assembly 10 is secured to the bottle top 14 resulting in a heat-sealed ring on the inner surface, shown as 18 in FIG. 3. The ring 18 is formed by having been heat sealed or induction sealed to an open top rim of the bottle 14 by heater means in the well-known industrial manner. Removal of this container cap has been known to randomly tear across the center of the cap, requiring the awkward manual removal of the remaining untabbed portion. The width of the ring 18 will vary as it registers with various bottle or container rim widths.

Figure 2:
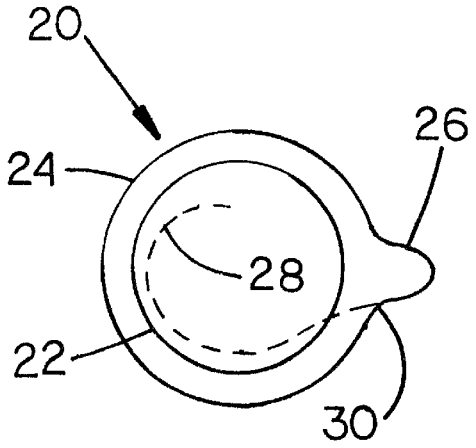
FIG. 2 is a plan view of the outer surface of a container cap blank embodying the invention.

FIG. 2 illustrates the outer surface of the container cap blank 20 of the invention, including a central portion 22, a peripheral ring portion 24 integral with the central portion, a lift tab 26 formed on an edge of the peripheral ring portion 24, and a weakened line 28. The latter line 28 may be an impressed score line, a cut line through the outer layer, or a series of perforations cut through the outer layer, hereinafter referred to as a weakened line, extending from an edge 30 of the lift tab 26 and extending first across the peripheral ring portion 24, and thence in an arcuate path around a predetermined segment of the central portion 22, to terminate toward the center thereof.

The container cap blank is generally cut, scored and formed from a web on which selected indicia may have been printed, and then mounted and sealed onto a container top.

Figure 3:
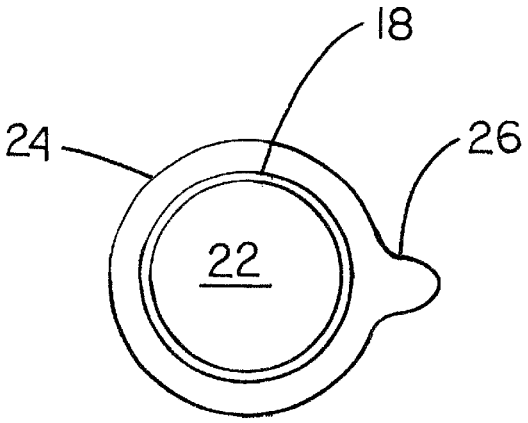
FIG. 3 is a plan view of the inner surface of a container cap blank embodying the invention.
Figure 7:
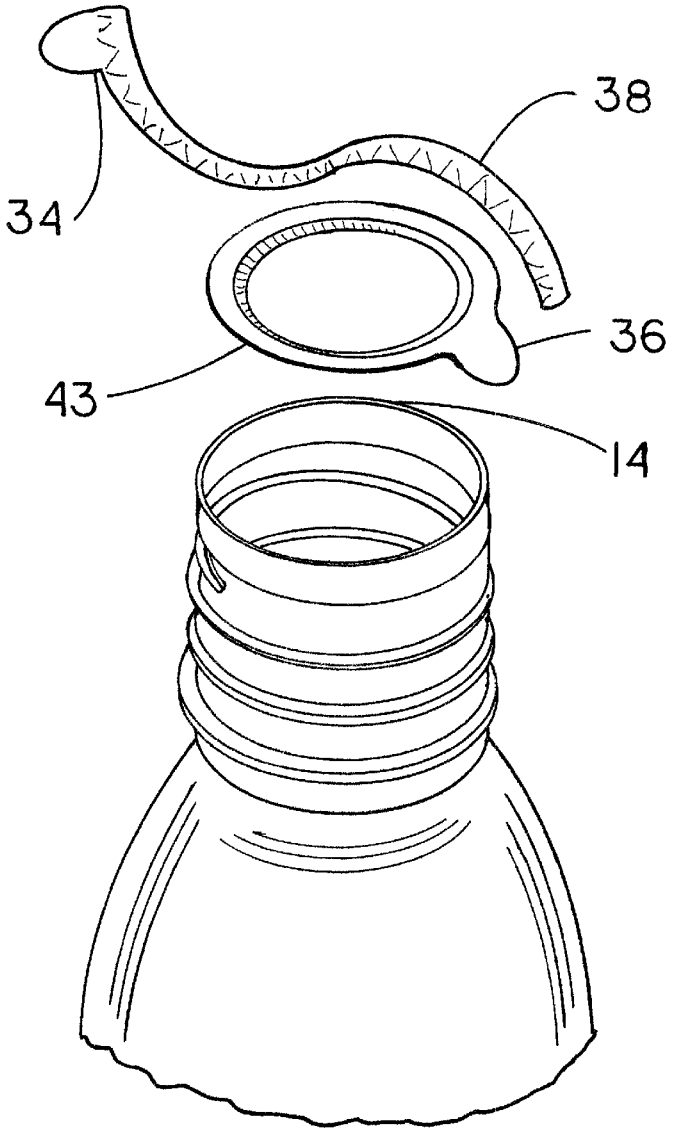
FIG. 7 is a perspective view of the container cap blank of FIG. 6 and a fragmentary bottle, and shown with each of a peripheral portion and a central portion thereof removed from a bottle.

FIG. 3 illustrates the inner surface of the blank 20 showing the above mentioned heat-sealable ring 18 formed on the central portion 22 as it would appear upon being sealed onto the rim of the bottle top 14 as the blank 20 is being mounted on the bottle top 14. The peripheral portion 24 is formed as a skirt surrounding the neck of the bottle top while the sealant layer of the central portion 22 is activated to become adhered in the ring 18 shape to the bottle top rim. In the same operation, the central portion 22 may remain flat, or be recessed as shown in FIGS. 1, 4 and 7.

Figure 4:
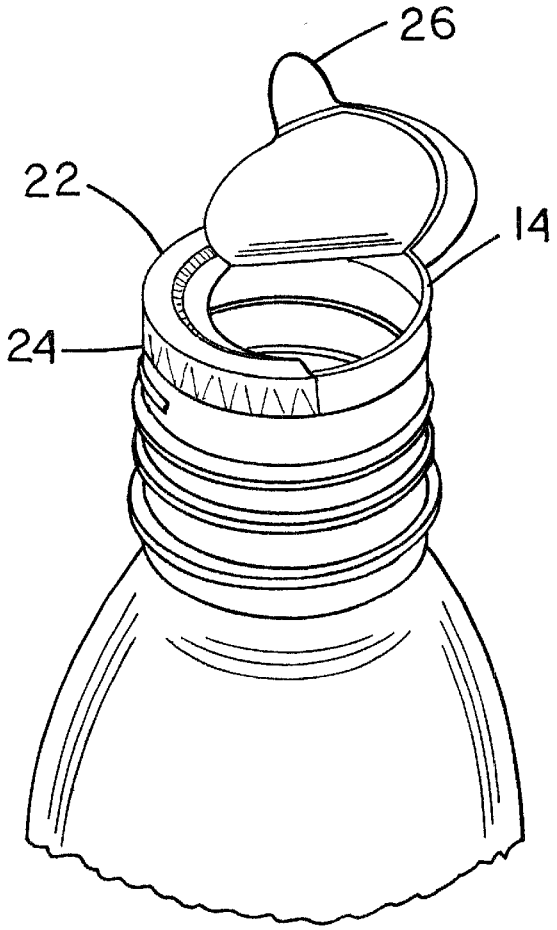
FIG. 4 is a perspective view of the container cap blank of FIGS. 2 and 3 in place on a bottle, and shown partially removed therefrom.

In the opening operation, as shown in FIG. 4, manually lifting the lift tab 26 serves to tear the weakened line 28 along its arcuate path. Upon reaching the end of the path, continued lifting of the lift tab 26 lifts the central portion 22 and the sealed ring 18 away from the bottle top rim.

Figure 2A:
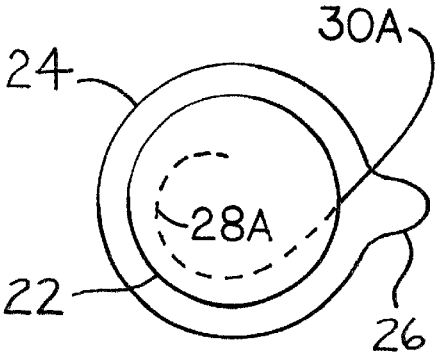
FIG. 2A is a plan view of a variation of the FIG. 2 embodiment.

FIG. 2A is similar to the FIG. 2 structure with the exception that the weakened line 28A originates at the opposite edge 40A of the lift tab 26 and encircles a predetermined portion for example, three fourths of the central portion 22.

Figure 5:
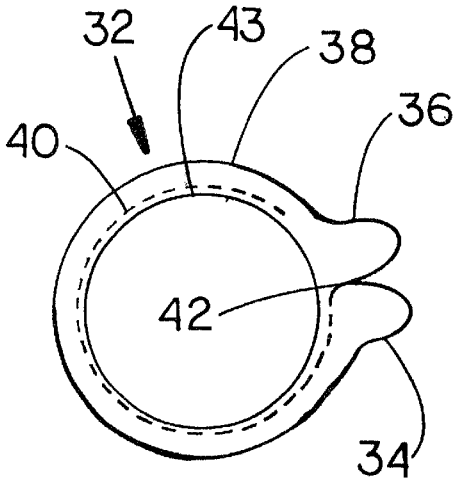
FIG. 5 is a plan view of the outer surface of a container cap blank of an alternate embodiment of the invention.

FIG. 5 illustrates a blank 32, wherein two side-by-side lift tabs 34 and 36 are formed to extend from the peripheral ring portion 38, and a weakened line 40 is formed to extend from an edge 42 of the lift tab 34 around the peripheral ring portion 38 to a predetermined point away from the lift tab 36. After assembly on the bottle top 14, lifting the lift tab 34 serves to tear the weakened line 40 around the skirt formed by the peripheral ring portion 38. At the end of the tear, lifting the other lift tab 36 removes the central portion from the bottle top rim, completing the one piece removal of the cap.

Depending upon where the weakened line 40 ends, it may be possible to remove the central portion 43 with continued lifting of the tab 34, without the need for an assist with the second lift tab 36.

Figure 5A:
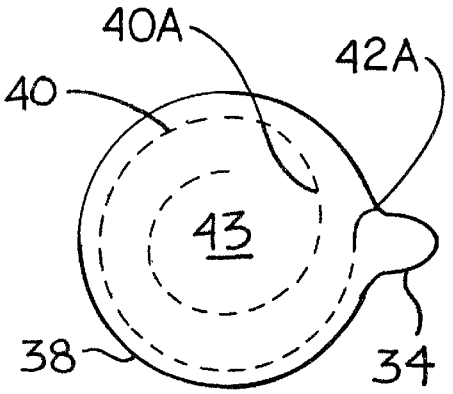
FIG. 5A is a plan view of a variation of the FIG. 5 embodiment.

FIG. 5A is somewhat similar to the FIG. 5 structure, but with only one left tab 34, and with an extension 40A of the weakened line 40 on FIG. 5, onto and around a predetermined major portion of the central portion.

Figure 6:
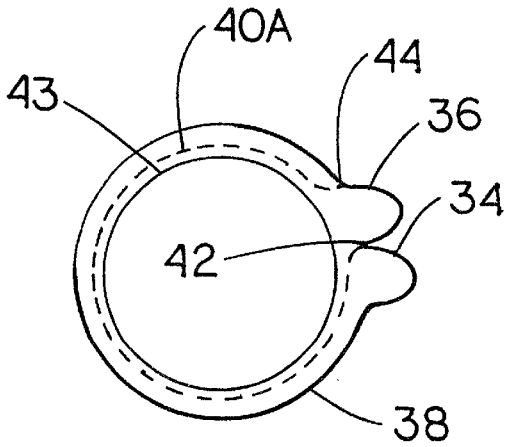
FIG. 6 is a plan view of the outer surface of a container cap blank of a second alternate embodiment of the invention.

As shown in FIG. 6, this structure is similar to the FIG. 5 structure except that the weakened line 40A extends all the way around the skirt 38 from an edge of the lift tab 34 to an edge 44 of the other lift tab 36. As such, lifting the tab 34 and tearing the weakened line 40A all the way to the lift tab 36 serves to separate the tab 34 and the skirt 38 completely from the bottle top 14, as shown in FIG. 7. Then, lifting the tab 36 completes the opening process by removing the second cap piece consisting of the central portion 22 and partial peripheral ring portion 38.

Figure 8:
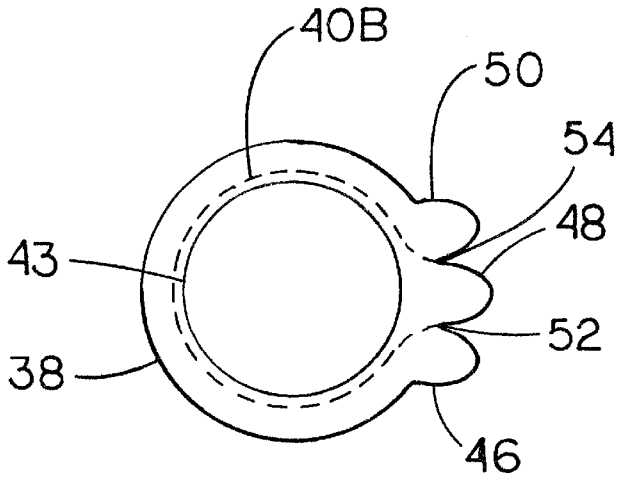
FIG. 8 is a plan view of the outer surface of a container cap blank of a third embodiment of the invention.

FIG. 8 is similar to FIG. 6 except that it includes three adjacent lift tabs 46, 48 and 50. In this arrangement, the weakened line 40B extends from an inner edge 52 of the lift tab 46 around the skirt to the inner edge 54 of the lift tab 50. Once assembled on the bottle top 14, the opening process may be conducted by lifting either outside lift tab 46 or 50, accommodating both right or left-handed users, and tearing the weakened line 40B all the way to thereby free the skirt 38 and both lift tabs 46 and 50 from the assembly. Next, lifting the original middle lift tab 48 removes the remaining central cover portion 43 from the bottle top 14 by breaking the sealed ring 18 (FIG. 3).

Figure 9:
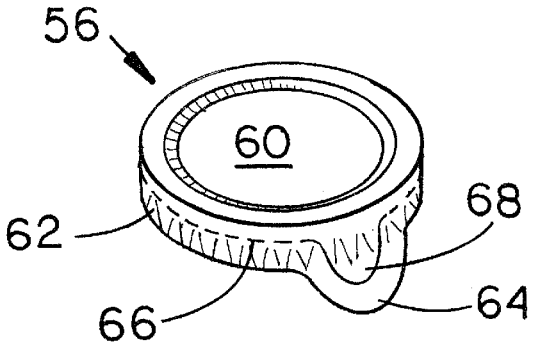
FIG. 9 is a perspective view of a further alternate embodiment of a bottle cap as it would be mounted on a bottle.
Figure 10:
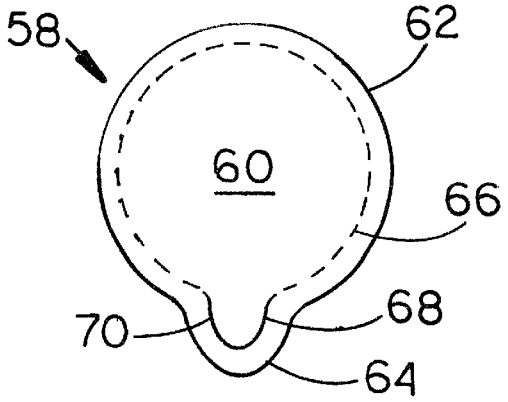
FIG. 10 is a plan view of the outer surface of a blank from which the cap of FIG. 9 is formed.

FIG. 9 illustrates a cap 56 which is formed on a bottle or other container (not shown) from a blank 58 shown in FIG. 10. The blank 58 is cut from a web (not shown) to include a central portion 60, a peripheral ring portion 62, integrally formed on the central portion 60, a lift tab 64 formed on an edge of the ring portion 62, and a weakened line 66. An inner tab 68 is formed in the center of the lift tab 64 by a through-cut line 70, with the weakened line 66 extending around the ring portion 62 from one edge of the inner tab 68 to the other.

Lifting the inner tab 68 serves to tear the weakened line 66 and remove the central portion 60 from the bottle top. Then lifting the tab 64 removes the skirt formed by the peripheral ring 62 as a separate second piece.

Figure 11:
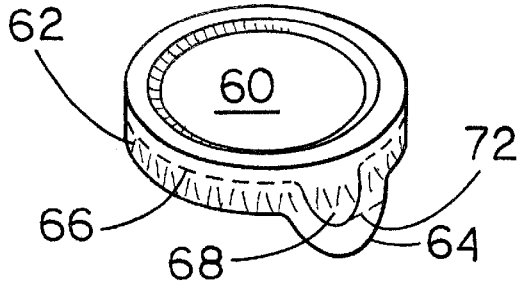
FIG. 11 is a perspective view of a further alternate embodiment of a bottle cap as it would be mounted on a bottle.
Figure 12:
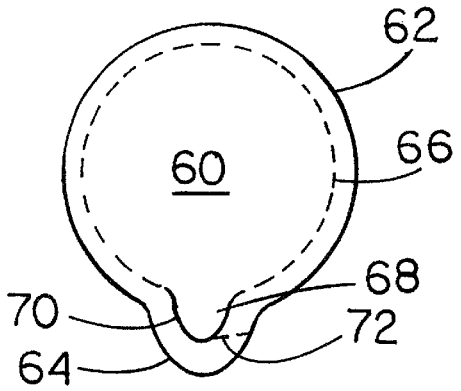
FIG. 12 is a plan view of the outer surface of a blank from which the cap of FIG. 11 is formed.

FIGS. 11 and 12 are similar to FIGS. 9 and 10, respectively, with the addition of a short weakened line 72 formed from the tip of the inner tab 68 sidewardly to an edge of the primary tab 64. Tearing the line 72 first assists in the lifting of the inner tab 68.

Figure 13:
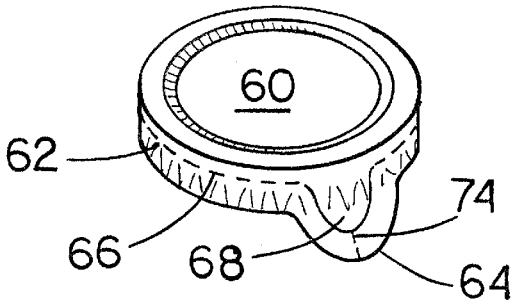
FIG. 13 is a perspective view of a further alternate embodiment of a bottle cap as it would be mounted on a bottle.
Figure 14:
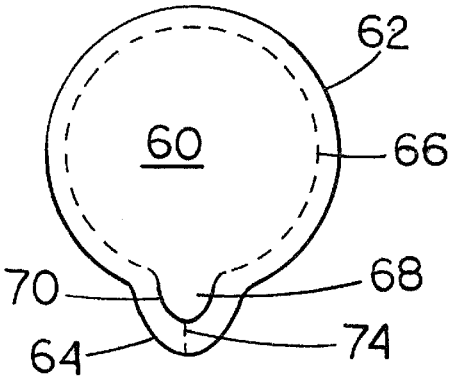
FIG. 14 is a plan view of the outer surface of a blank from which the cap of FIG. 13 is formed.

FIGS. 13 and 14 are also similar to FIGS. 9 and 10, respectively, with the addition of a short weakened line 74 formed from the tip of the inner tab 68 to the tip of the tab 64 for the same purpose as the line 72.

Figure 15:
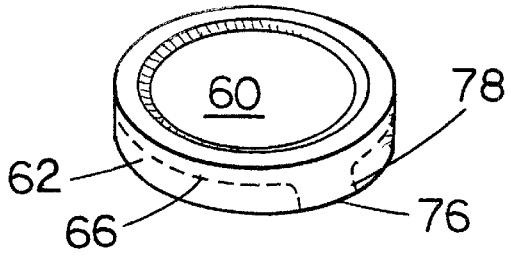
FIG. 15 is a perspective view of a further alternate embodiment of a bottle cap as it would be mounted on a bottle.
Figure 16:
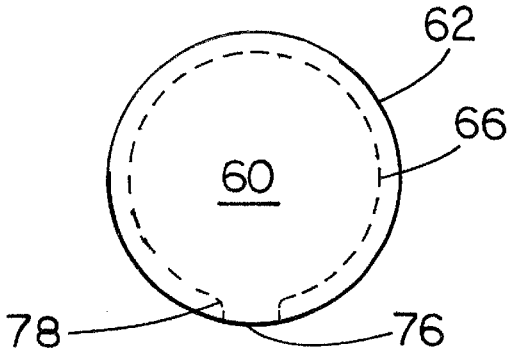
FIG. 16 is a plan view of the outer surface of a blank from which the cap of FIG. 15 is formed.

In FIGS. 15 and 16, elements similar to FIGS. 9 and 10 bear the same reference numerals. In lieu of the extended primary and inner lift tabs 64 and 68, respectively, a lift tab 76 is formed by weakened lines 78 extending from spaced-apart ends of the weakened line 66 to the edge of the peripheral ring portion 62. Lifting the tab 76 tears the weakened line 66 to remove the central portion 60 leaving an easily removable broken skirt 62.

Figure 17:
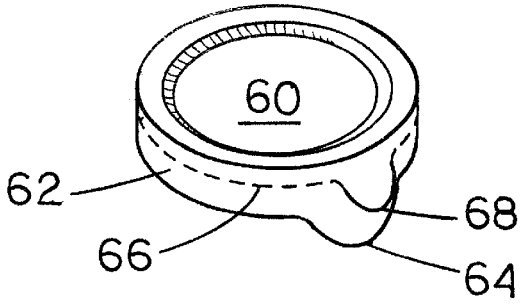
FIG. 17 is a perspective view of a further alternate embodiment of a bottle cap as it would be mounted on a bottle.
Figure 18:
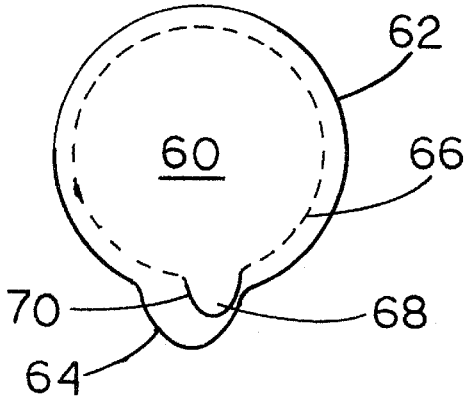
FIG. 18 is a plan view of the outer surface of a blank from which the cap of FIG. 17 is formed.

FIGS. 17 and 18 are similar to FIGS. 9 and 10, respectively, except that the inner lift tab 68 is formed off-center on the primary lift tab 64 such that an edge thereof is closely adjacent an edge of the tab 64 for easy access thereto.

Figure 19:
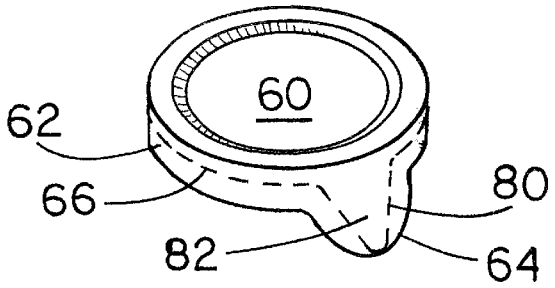
FIG. 19 is a perspective view of a further alternate embodiment of a bottle cap as it would be mounted on a bottle.
Figure 20:
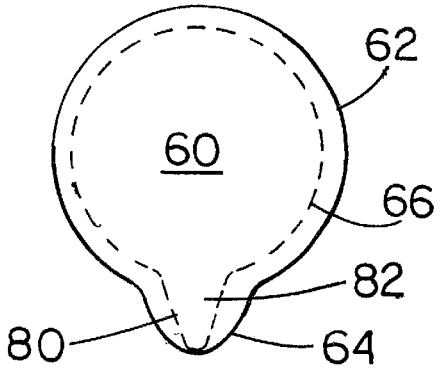
FIG. 20 is a plan view of the outer surface of a blank from which the cap of FIG. 19 is formed.

FIGS. 19 and 20 include elements the same as FIGS. 9 and 10, respectively, except that in lieu of the inner tab 68, a substantially V-shaped weakened line 80 is formed on the lift tab 64 to the tip thereof, extending from the spaced-apart ends of the weakened line 66, and forming an internal lift tab 82. As such, if preferred by the user, either side of the lift tab 64 may be broken away from the 82 to thereby tear the weakened line 66 and remove the skirt 62 first, leaving the second central part 60 to be removed by lifting the remaining tab 82. Alternately, the internal tab 82 may be lifted first by breaking the weakened line 80 and tearing the surrounding weakened line 66 to remove the central portion 60, and leaving a broken skirt portion 62.

INDUSTRIAL APPLICABILITY

It should be apparent that the invention provides an improved, novel and uncomplicated container cap structure which may be efficiently and readily removed from a container top to which it is adhered.

It should be further apparent that various embodiments are possible within the scope of the invention, whereby the container cap may include single or multiple lift tabs, may be removed in one or more pieces; and may include a weakened tear line such as a score line, a perforated line, or a partial or through cut, or a combination thereof, formed on one or the other, or both, of a cap skirt and a central portion adhered to a container rim.

It should be further apparent that, should particular containers require it, cap shapes other than the circular caps shown are possible.

It is well known in the industry that the caps as shown may be cut, perforated, scored, formed, mounted and sealed in a predetermined sequence onto bottle or container tops, for example, from web rolls upon which selected indicia may have been printed.

While twelve embodiments of the invention have been shown and described, other modifications thereof are possible within the scope of the following claims.

What is claimed is:

1. For use on a container top, a container cap having a central portion adapted to being secured only to the container top edge, a loose peripheral portion integral with the central portion adapted to be formed into a skirt around the neck of the container top, and a lift tab formed on or extending from the loose peripheral portion, the improvement comprising a weakened line formed on one or the other, or both, of said central portion or around a predetermined portion of said loose peripheral portion, extending from at least one edge of said lift tab.

2. The improvement described in claim 1, wherein said weakened line is one of a score line, or perforated line partially cut through, a partially cut through continuous or intermittent line, and a through cut line in said lift tab or said peripheral portion, or a combination thereof.

3. The improvement described in claim 1, wherein said weakened line extends across said loose peripheral portion and in a predetermined arcuate configuration on said central portion, terminating with an inwardly bending segment.

4. The improvement described in claim 1, and a second lift tab extending from said loose peripheral portion, wherein said weakened line extends from one edge of one of said lift tabs around a predetermined segment of said peripheral portion, with said second lift tab adapted to serve as an assist in removing the cap once the weakened line has been tom by lifting said one lift tab.

5. The improvement described in claim 1, and a second lift tab extending from said peripheral portion, wherein said weakened line extends from an edge of one of said lift tabs around said loose peripheral portion to an edge of second lift tab, with said one lift tab adapted to remove said loose peripheral portion upon tearing said weakened line, and said second lift tab adapted to remove said central portion from said container top.

6. The improvement described in claim 1, and second and third lift tabs forming two outside and one intermediate lift tabs connected to said loose peripheral portion, wherein said weakened line extends from an edge of one of said outside lift tabs to an edge of the other outside lift tab, with either of said outside lift tabs adapted to remove said loose peripheral portion upon tearing said weakened line with either a left or right hand and said intermediate lift tab adapted to remove said central portion from said bottle top.

7. The improvement described in claim 1, wherein said weakened line is formed as one of a score line, a series of perforations cut through and a continuous cut line through.

8. A heat-sealable cap for use on a container top, said cap comprising a central portion, a peripheral portion formed around said central portion, a lift tab formed on said peripheral portion, and a weakened line formed to extend from only one edge of said lift tab across said peripheral portion and thence in a predetermined configuration on said central portion, whereby said cap is adapted to be removed in one piece upon lifting said lift tab and tearing along said weakened line.

9. A heat-sealable cap for use on a container top, said cap comprising a central portion, secured only to the edge of said container top, a loose peripheral portion formed around said central portion, at least one lift tab formed on said loose peripheral portion, and a weakened line formed from only one edge of said lift tab around a predetermined length of said loose peripheral portion, whereby said entire cap is adapted to be removed in one piece upon lifting said lift tab and tearing along said weakened line from the edge of said lift tab to the end thereof.

10. The cap described in claim 9, and a second lift tab formed on said peripheral portion adapted to be used to assist in the one piece removal of said cap at the completion of the tearing of said weakened line.

11. A heat-sealable cap for use on a container top, said cap comprising a central portion, a loose peripheral portion formed around said central portion, a lift tab formed on said peripheral portion, and a weakened line formed around a predetermined length of said peripheral portion from only one edge of said lift tab and thence onto and around a predetermined portion of said central portion, whereby said cap is adapted to be removed in one piece upon lifting said lift tab and tearing said weakened line.

12. A heat-sealable cap for use on a container top, said cap comprising a central portion secured only to an edge of the container top, a loose peripheral portion formed around said central portion, first and second lift tabs formed on said loose peripheral portion, and a weakened line formed around said loose peripheral portion extending from an edge of said first lift tab to an edge of said second lift tab, whereby said loose peripheral portion is adapted to be removed upon lifting said first tab and tearing said weakened line to said second lift tab, and whereby said central portion is adapted to then be removed upon lifting said second lift tab.

13. A heat-sealable cap for use on a container top, said cap comprising a central portion adapted to being secured only to an edge of the container top, a loose fitting peripheral portion formed around said central portion, first and second spaced apart lift tabs and an intermediate lift tab formed on said loose fitting peripheral portion, and a weakened line formed around said loose fitting peripheral portion extending from an inner edge of said first lift tab to an inner edge of said second lift tab, whereby said loose fitting peripheral portion is adapted to be removed upon lifting either the first or second lift tab and tearing said weakened line, and whereby said central portion is adapted to then be removed upon lifting said intermediate lift tab.

14. A heat sealable cap for use on a container top, said cap comprising a central portion, a peripheral portion formed around said central portion, a primary lift tab formed on said peripheral portion, an inner lift tab cut into said primary lift tab, and a weakened line formed around said peripheral portion extending from one edge of said inner lift tab to the other edge of said inner lift tab, whereby said central portion is adapted to be removed upon lifting said inner lift tab and tearing said weakened line, and whereby said peripheral portion exterior of the weakened line is adapted to be removed upon lifting said primary lift tab.

15. The improvement described in claim 14, and a second weakened line formed on said primary lift tab between the tip of said inner lift tab and an edge of said primary lift tab.

16. The improvement described in claim 14, wherein said inner lift tab is formed as a V-shaped weakened line extending from said peripheral weakened line to an edge of said primary lift tab.

17. A heat sealable cap for use on a container top, said cap comprising a central portion sealable on the edge of the container top, a loose peripheral portion formed around said central portion, and a weakened line formed around said loose peripheral portion with ends thereof spaced a predetermined distance apart and bending outwardly to terminate at an edge of said peripheral portion, thereby forming a lift tab therebetween, whereby, upon lifting said lift tab, said central portion and the part of said loose peripheral portion between the central portion and the weakened line are lifted from the container top, with the remaining loose peripheral portion filing free.

* * * * *

UNITED STATES PATENT AND TRADEMARK OFFICE

CERTIFICATE OF CORRECTION

PATENT NO. : 6,474,490 B1
DATED : November 5, 2002
INVENTOR(S) : Lawrence P. Seibel et al.

It is certified that error appears in the above-identified patent and that said Letters Patent is hereby corrected as shown below:

Column 5,
Line 16, after "from the" insert therein -- internal tab --

Column 8,
Line 22, after "peripheral portion" delete "filing" and insert therein -- falling --

Signed and Sealed this

Seventeenth Day of February, 2004

JON W. DUDAS
*Acting Director of the United States Patent and Trademark Office*